US005347802A

United States Patent [19]

Stahlecker et al.

[11] Patent Number: 5,347,802

[45] Date of Patent: Sep. 20, 1994

[54] SPINNING OR TWISTING SPINDLE

[75] Inventors: Hans Stahlecker, Haldenstrasse 20, 7334 Süssen, Fed. Rep. of Germany; Gerd Stahlecker, Eislingen/Fils, Fed. Rep. of Germany

[73] Assignees: Fritz Stahlecker; Hans Stahlecker, Fed. Rep. of Germany

[21] Appl. No.: 596,029

[22] Filed: Oct. 11, 1990

[30] Foreign Application Priority Data

Oct. 19, 1989 [DE] Fed. Rep. of Germany ..... 3934843

[51] Int. Cl.[5] ..... D01H 7/14; D01H 7/22

[52] U.S. Cl. ..... 57/88; 57/132; 57/135

[58] Field of Search ..... 57/88, 130, 132, 133, 57/134, 135

[56] References Cited

U.S. PATENT DOCUMENTS

| | | | |
|---|---|---|---|
| Re. 285,510 | 8/1975 | Anderson et al. | 57/88 |
| 1,875,938 | 9/1932 | Schaum | 57/132 |
| 2,411,127 | 11/1946 | Burnham | 57/88 |
| 3,122,875 | 3/1964 | Swift et al. | 57/88 |
| 3,141,288 | 7/1964 | Carroll | 57/88 |
| 3,226,923 | 1/1966 | Maurer | 57/88 |
| 3,513,652 | 10/1968 | Hare | 57/88 |
| 3,673,783 | 7/1972 | Timbie | 57/88 X |
| 3,681,908 | 8/1972 | Hohlock | 57/88 |
| 3,808,790 | 5/1974 | Preston et al. | 57/88 |
| 4,662,165 | 5/1987 | Menegatto | 57/88 |
| 4,756,150 | 7/1988 | Schmitt et al. | 57/88 |

FOREIGN PATENT DOCUMENTS

| | | | |
|---|---|---|---|
| 886262 | 7/1953 | Fed. Rep. of Germany | 57/88 |
| 1560295 | 12/1966 | Fed. Rep. of Germany . | |
| 2906226 | 2/1979 | Fed. Rep. of Germany . | |
| 3620497 | 6/1986 | Fed. Rep. of Germany . | |
| 331685 | 7/1930 | United Kingdom | 57/132 |

*Primary Examiner*—Daniel P. Stodola
*Attorney, Agent, or Firm*—Evenson, McKeown, Edwards & Lenahan

[57] ABSTRACT

In the case of a spinning or twisting spindle, a plate, which is clamped in between a flange of a spindle bearing housing and a spindle rail, is provided as the common holding element for a securing hook and a brake.

19 Claims, 1 Drawing Sheet

SPINNING OR TWISTING SPINDLE

BACKGROUND AND SUMMARY OF THE INVENTION

The invention relates to a spinning or twisting spindle having a spindle top part which comprises a driving wharve and is disposed in a spindle bearing housing by means of a spindle shaft. The spindle bearing housing is provided with a flange which can be fastened to a spindle rail. A brake is provided that can be applied to the driving wharve and is held in a holder which can be arranged between the spindle rail and the flange. A securing hook is provided which can be swivelled away and reaches around a ring collar of the driving wharve.

In the case of spinning or twisting spindles of the initially mentioned type disclosed in U.S. Pat. No. 3,122,875, a separate holder is provided for the securing hook which is screwed or welded to the flange of the spindle bearing housing. The holder for the brake is a separate component which is also mounted on the flange of the spindle bearing housing.

It is also known from German Patent Document DE-A 15 60 295 to construct a support for a securing hook reaching around a collar of the driving wharve as a fork-shaped plate which can be slid into lateral transverse grooves of the spindle bearing housing.

It is also known from German Patent Document DE-A 29 06 226 to dispose the bearing journals of a spindle brake in recesses of the flange of the spindle bearing housing which are open in the direction of the spindle bearing rail.

In all these constructions, it is required to develop the flange of the spindle bearing housing, already at the time of manufacturing, in such a manner that it can accommodate a spindle brake and/or a securing hook. The decision concerning the mounting of the spindle brake and/or of the securing hook as well as concerning the mounting of their holding devices therefore must be made as early as during the manufacturing and designing phase. For the purpose of noise reduction, it has become known to use a divided fastening flange with damping material disposed inbetween, instead of a one-piece rigid flange (see German Patent Document DE-A 36 20 497). Conventional spindle brakes and securing hooks cannot be used for constructions of this type.

It is an object of the invention to provide a construction for the spindle brake and the securing hook which is as universal as possible, is largely independent of the construction of the flange of the spindle bearing housing, and makes it possible that the decision as to whether the spindle brake and/or the securing hook are to be used can still also be made at the time of the mounting of the spindles.

This object is achieved according to preferred embodiments of the invention in that a plate is provided which can be clamped between the flange and the spindle rail and which is equipped with holding devices for the brake and with holding devices for the securing hook.

By means of this development, it is achieved that the holding device for the brake as well as the holding device for the securing hook are practically independent of the flange of the spindle bearing housing so that, in the operating sequence, it does not have to be decided before the mounting or even later whether the machine is to be used with or without a securing hook and/or a spindle brake. In addition, the mounting expenditures are very low because the plate is simply mounted in the manner of a washer between the flange of the spindle bearing housing and the spindle rail.

In an advantageous development of the invention, it is provided that the holding devices for the brake and/or for the securing hook are integrally shaped to the plate. In this case, it is particularly advantageous if, in a further development, the plate is a punched and bent sheet metal part. The holding devices can be shaped very easily to a sheet metal part of this type.

In a further development of the invention, it is provided that the plate is constructed as a structural unit with the brake and the securing hook. This type of a structural unit can then be preassembled as such, can be transported in this form and can mounted during the assembly.

Other objects, advantages and novel features of the present invention will become apparent from the following detailed description of the invention when considered in conjunction with the accompanying drawings.

DETAILED DESCRIPTION OF THE DRAWINGS

Figure 1:
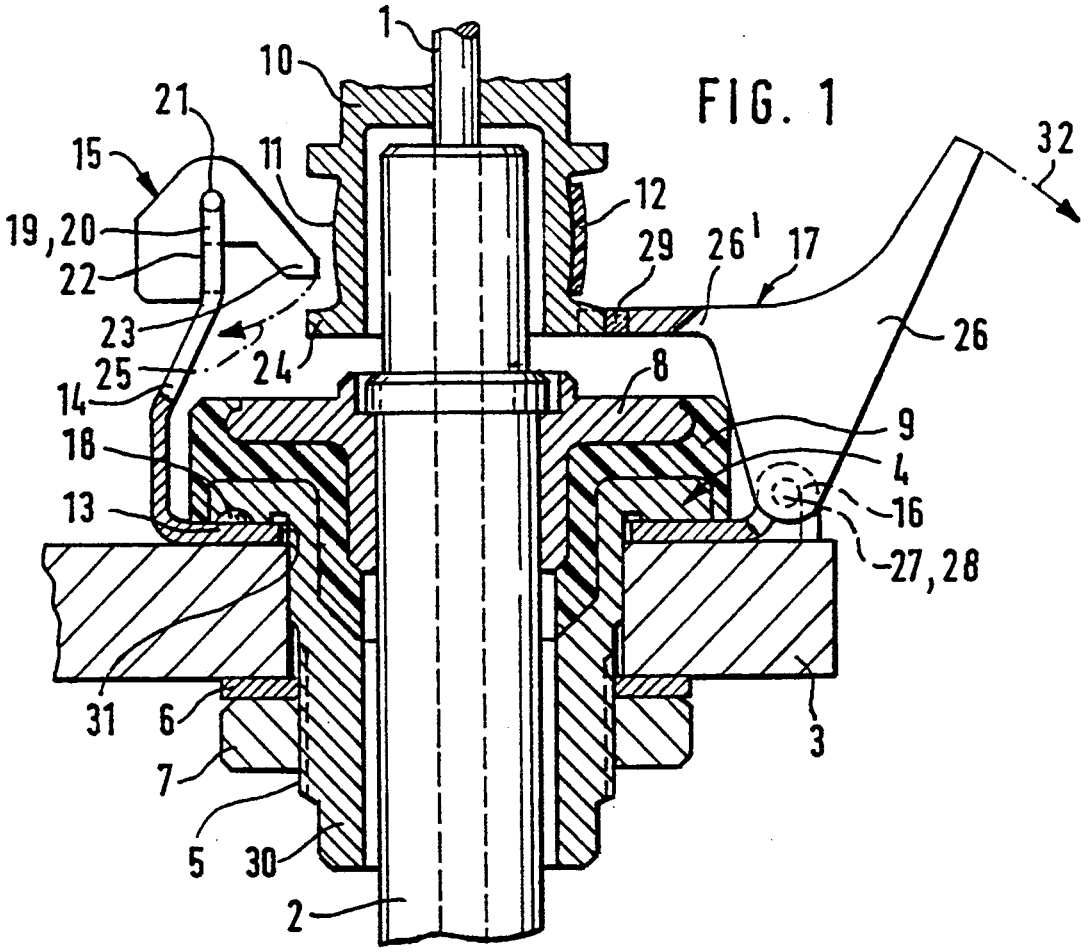
FIG. 1 is a schematic longitudinal sectional view of a spinning spindle constructed according to a preferred embodiment of the invention.
Figure 2:
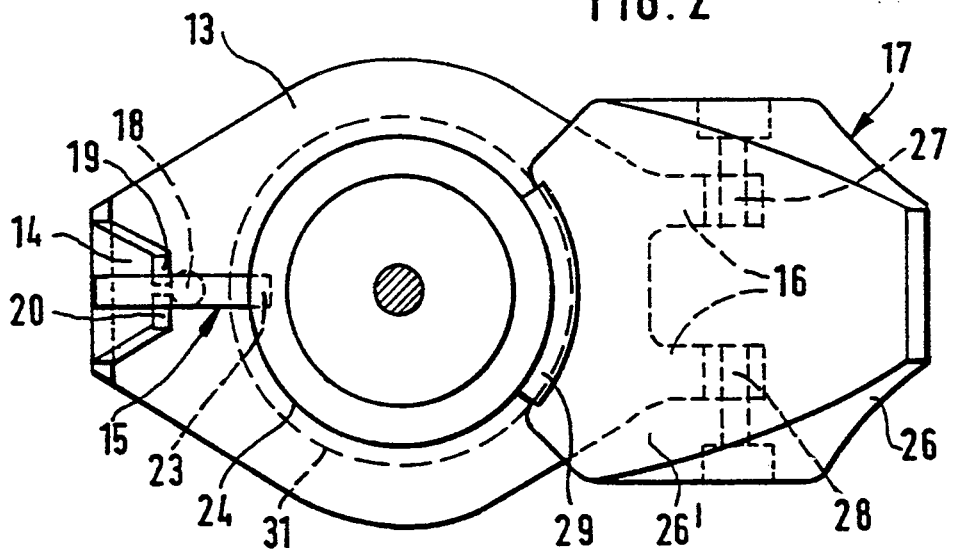
FIG. 2 is a top view of the structural unit comprising the brake and the securing hook.

The spindle shown in FIG. 1 has a spindle top part 10 which, by means of a spindle shaft 1, is disposed in a spindle bearing housing 2. The spindle bearing housing 2 is provided with a flange assembly 4 by means of which it is fastened to a spindle rail 3. The flange assembly 4 comprises a flange part 8 which is fixedly connected with the spindle bearing housing 2 and a flange part 30 which penetrates the spindle rail 3 in the manner of a sleeve, these flange parts being connected with one another by way of an elastic damping material 9 such that no metallic connection exists between the spindle rail 3 and the spindle bearing housing 2. The sleeve-type flange part 30 is provided with an external thread 5 onto which a fastening nut 7 is screwed which, with the insertion of a disk 6, clamps the flange assembly 4 together with the spindle rail 3.

The spindle top part 10 has a slightly spherical wharve 11 against which a tangential belt 12 moves. In the downward direction, the wharve 11 is bounded by a ring collar 24 to which a brake 17 is assigned. In addition, a securing hook 15 is assigned to this ring collar 24 and reaches over this ring collar 24 at a short vertical distance so that an unintentional pulling-out or moving-out of the spindle top part 10 from the spindle bearing housing 2 is prevented.

The securing hook 15 and the brake 17 are mounted on a common holding element which is constructed as a plate 13 which has a bore 31 adapted to the sleeve-type flange part 30 and which is clamped in between the flange 4 and the spindle rail 3. The plate 13 is manufactured as a punched and bent sheet metal part to which the holding devices are shaped for the securing hook 15 and the brake 17.

An arm 14 which projects upward essentially in parallel to the spindle shaft 1 is shaped to the plate 13 and ends in two legs 19, 20 arranged in the manner of a fork.

The legs 19, 20 extend diagonally toward one another in the upward direction and project into a transverse bore 21 of the securing hook 15. By means of the elastic expanding of the two legs 19, 20, a type of clipped connection can be achieved between the securing hook 15 and the arm 14. The securing hook 15 has a hook arm 23 which projects into the area of the ring collar 24 of the wharve 11. On the side which is opposite with respect to the bore 21, the securing hook 15 has an arm having a higher inherent weight which, in the operating position, by means of a stop face 22, rests against the arm 14 of the plate 13, as shown in FIG. 1. In order to be able to pull the spindle top part 10 out of the bearing housing 2, the securing hook 15 is swivelled around its transverse bore 21 serving as an axis of rotation in the direction of the arrow 25. After being released, it resumes the illustrated securing position as a result of its own weight.

On the side which is opposite the arm 14 with respect to the bore 31, two brackets 16 are shaped onto the plate 13 which are bent to form bearing receiving devices. Bearing journals 27, 27 of the brake 17 are clipped into these bearing receiving devices which form only a partial cylinder. These bearing journals 27, 28 are shaped onto a structural component forming the brake 17 which is preferably made of plastic. This structural component forms an actuating lever 26 which is manufactured integrally with an arm serving as a braking lever 26. This arm 26' serving as a braking lever carries a brake pad 29 adapted to the circumference of the ring collar 24 of the wharve 11 by which, in the braking position illustrated in FIG. 1, it is pressed to the ring collar 24 for the purpose of braking. The brake 17 is constructed such that, as a result of its own weight, it falls back automatically around the bearing journals 27, 28 in the direction of the arrow 32 into the opened position after an actuating.

In order to secure the installed position of the plate 13, this plate must be provided with an upwardly projecting cam 18 which engages in a corresponding recess of the flange 4 of the spindle bearing housing 2. In the case of a modified embodiment, it is provided that the plate 13 in its specified operating position is aligned with respect to the spindle rail 3. This may take place, for example, in that a third bracket is shaped on between the brackets 16, this third bracket, by means of a hook-shaped bent end, reaching around the front edge of the spindle rail.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning or twisting spindle arrangement comprising:

a spindle top part which includes a driving wharve, a spindle bearing housing, the spindle bearing housing being provided with a flange which can be fastened to a spindle rail, a spindle shaft connected to the spindle top part and extending in the spindle bearing housing, a brake that can be applied to the driving wharve and is held in a holder which is arranged between the spindle rail and the flange, and a securing hook which can be swivelled away and is engageable with a ring collar of the driving wharve, wherein a single plate is provided which is clamped between the flange and the spindle rail and which is provided with the holder for the brake and with holding devices for the securing hook, whereby the brake and securing hook is separately assembled from the spindle bearing housing and is detachably connected as a unit via the single plate clamped between the flange and spindle rail.

2. A spinning or twisting spindle according to claim 1, wherein the holder for the brake and the holding devices for the securing hook are integrally shaped at the plate.

3. A spinning or twisting spindle according to claim 2, wherein the plate forms a structural unit with portions of the brake and the securing hook.

4. A spinning or twisting spindle according to claim 2, wherein the plate is a punched and bent sheet metal part.

5. A spinning or twisting spindle according to claim 4, wherein the plate is provided with at least one projection projecting away from it in parallel to the direction of the spindle shaft.

6. A spinning or twisting spindle according to claim 5, wherein the plate forms a structural unit with portions of the brake and the securing hook.

7. A spinning or twisting spindle according to claim 6, wherein the brake is constructed as a component which can be swivelled with respect to the spindle shaft and which has an actuating lever and a braking lever provided with a brake lining as well as bearing journals which are clipped into bearing accommodating devices of the plate.

8. A spinning or twisting spindle according to claim 7, wherein the flange includes a first part mounted on the spindle bearing housing and a second part that can be mounted on the spindle rail, said first and second parts being connected with one another by means of damping material.

9. A spinning or twisting spindle according to claim 1, wherein the flange includes a first part mounted on the spindle bearing housing and a second part that can be mounted on the spindle rail, said first and second parts being connected with one another by means of damping material.

10. A spinning or twisting spindle according to claim 1, wherein the plate is provided with at least one projection projecting away from it in parallel to the direction of the spindle shaft.

11. A spinning or twisting spindle according to claim 1, wherein the plate forms a structural unit with portions of the brake and the securing hook.

12. A spinning or twisting spindle according to claim 1, wherein the brake is constructed as a component which can be swivelled with respect to the spindle shaft and which has an actuating lever and a braking lever provided with a brake lining as well as bearing journals which are clipped into bearing accommodating devices of the plate.

13. A spinning or twisting spindle according to claim 12, wherein the brake is constructed to form a one-piece structural component made of plastic with the actuating lever, the brake lever and the bearing journals.

14. A spinning or twisting spindle according to claim 1, wherein the plate is a punched and bent sheet metal part.

15. A spinning or twisting spindle according to claim 14, wherein the brake is constructed as a component which can be swivelled with respect to the spindle shaft and which has an actuating lever and a braking lever provided with a brake lining as well as bearing journals which are clipped into bearing accommodating devices of the plate.

16. A spinning or twisting spindle according to claim 14, wherein the brake is constructed to form a one-piece structural component made of plastic with the actuating lever, the brake lever and the bearing journals.

17. A spinning or twisting spindle according to claim 14, wherein the securing hook is held in a forkshaped holding device, the legs of which fork type holding device engage in a transverse bore of the securing hook.

18. A spinning or twisting spindle according to claim 14, wherein the flange includes a first part mounted on the spindle bearing housing and a second part that can be mounted on the spindle rail, said first and second parts being connected with one another by means of damping material.

19. A spinning or twisting spindle according to claim 1, wherein the securing hook is held in a forkshaped holding device, the legs of which fork type holding device engage in a transverse bore of the securing hook.

* * * * *